US007156621B2

(12) United States Patent
Stone

(10) Patent No.: US 7,156,621 B2
(45) Date of Patent: Jan. 2, 2007

(54) BLADE FIXING RELIEF MISMATCH

(75) Inventor: Paul Stone, Guelph (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 10/845,190

(22) Filed: May 14, 2004

(65) Prior Publication Data

US 2005/0254953 A1 Nov. 17, 2005

(51) Int. Cl.
*F01D 5/30* (2006.01)

(52) U.S. Cl. ..... 416/219 R; 416/220 R; 416/248; 29/407.01; 29/407.08; 29/557; 29/889.21

(58) Field of Classification Search ..... 416/219 R, 416/220 R, 221, 248; 29/407.01, 407.08, 29/557, 889.21, 889.22
See application file for complete search history.

(56) References Cited

U.S. PATENT DOCUMENTS

| | | | | |
|---|---|---|---|---|
| 3,572,970 | A * | 3/1971 | Smuland | 416/221 |
| 3,832,092 | A * | 8/1974 | Manharth | 416/220 R |
| 5,135,354 | A | 8/1992 | Novotny | |
| 5,141,401 | A | 8/1992 | Juenger et al. | |
| 5,160,242 | A | 11/1992 | Brown | |
| 5,310,318 | A | 5/1994 | Lammas et al. | |
| 5,395,213 | A | 3/1995 | Stenneler | |
| 5,443,365 | A * | 8/1995 | Ingling et al. | 416/193 A |
| 5,567,116 | A | 10/1996 | Bourcier | |
| 6,019,580 | A | 2/2000 | Barr et al. | |
| 6,033,185 | A | 3/2000 | Lammas et al. | |
| 6,065,938 | A | 5/2000 | Bartsch | |
| 6,183,202 | B1 | 2/2001 | Ganshaw | |
| 6,244,822 | B1 * | 6/2001 | Sinclair et al. | 416/219 R |
| 6,375,429 | B1 | 4/2002 | Halila et al. | |
| 6,435,833 | B1 | 8/2002 | Reluzco et al. | |
| 6,435,834 | B1 | 8/2002 | Reluzco et al. | |
| 6,439,851 | B1 | 8/2002 | Wong | |
| 6,592,330 | B1 | 7/2003 | Lecke et al. | |
| 2004/0076523 | A1 | 4/2004 | Sinha et al. | |

FOREIGN PATENT DOCUMENTS

| | | |
|---|---|---|
| EP | 1 411 208 | 4/2004 |
| EP | 1 433 959 | 6/2004 |
| JP | 63-134804 | 6/1988 |

OTHER PUBLICATIONS

NIL.

* cited by examiner

*Primary Examiner*—Christopher Verdier
(74) *Attorney, Agent, or Firm*—Ogilvy Renault LLP

(57) ABSTRACT

A blade fixing and blade mounting slot arrangement for a gas turbine engine has a mismatch fit along a portion of the length of the blade fixing and slot where contact stress would otherwise be maximal.

7 Claims, 3 Drawing Sheets

BLADE FIXING RELIEF MISMATCH

BACKGROUND OF THE INVENTION

1. Field of the Invention

The present invention relates to gas turbine engines and, more particularly, to blade and disk interfaces of such engines.

2. Background Art

Fan rotors can be manufactured integrally or as an assembly of blades around a disk. In the case where the rotor is assembled, the fixation between each blade and the disk has to provide retention against extremely high radial loads. This in turn causes high radial stress in the disk retaining the blades.

In the case of "swept" fans, the blades are asymmetric with respect to their radial axis. A significant portion of the weight of these blades is cantilevered over the front portion of the fixation, which causes an uneven axial distribution of the radial load on the fixation and disk. This load distribution causes high local radial stress in the front of the disk and high contact forces between the blade and the front of the disk.

Although a number of solutions have been provided to even axial distribution of stress in blades, such as grooves in blade platforms to alleviate thermal and/or mechanical stresses, these solutions do not address the problem of high local radial stress in the disk supporting the blades.

Some solutions have also been provided to reduce the increase of contact stress resulting in a non-zero broach angle of the blade, including the elimination of diagonally opposite portions of the load transfer interface which are less stressed. However, such solutions are not applicable to reduce the increased local contact stress produced by the asymmetry of "swept" fans. In addition, such solutions do not address the problem of high local radial stress in the disk supporting the blades.

Accordingly, there is a need for a blade and disk interface for a gas turbine engine fan producing reduced local contact stress and reduced local radial stress in the disk.

SUMMARY OF INVENTION

It is a general aim of the present invention to provide an improved blade and disk interface for a gas turbine engine.

It is also an aim of the present invention to provide a method for reducing a local contact stress between a disk and a blade.

It is a further aim of the present invention to provide a method for reducing a local radial stress in a bladed rotor disk assembly.

Therefore, in accordance with a general aspect of the present invention, there is provided a gas turbine engine rotor assembly comprising a rotor disk having a plurality of blade mounting slots circumferentially distributed about a periphery thereof for receiving complementary blade fixing portions of rotor blades, each of said blade mounting slots being bounded by a pair of opposed sidewalls extending longitudinally from a front side to a rear side of the rotor disk, and wherein a localized lateral play is provided between the sidewalls of each slot and the blade fixing portion of a respective one of the rotor blades along a longitudinal portion where contact stress is known to be maximal, said longitudinal portion being smaller than a length of the blade mounting slot and the blade fixing portion. In accordance with another feature of the present invention, the localized lateral play is at least partty provided by a region of reduced width in the blade fixing portion.

In accordance with a further general aspect of the present invention, there is provided a gas turbine engine rotor blade mountable in a blade retaining slot of a rotor disk, the rotor blade comprises a platform, an airfoil portion extending upwardly from said platform, a root depending downwardly from said platform and adapted for engagement in the blade retaining slot of the rotor disk, said root having a length extending from a front side to a rear side of the root, and wherein the root has a localized reduced width along a portion of the length thereof in a region where contact stress between the root and the slot is known to be high.

In accordance with a further general aspect of the present invention, there is provided a method for reducing high local stress transfer between a gas turbine engine blade fixing and a blade mounting slot of a rotor disk, the method comprising the steps of: a) determining which portion of a full length of the blade fixing and the blade mounting slot is subject to maximal contact stresses, and b) providing a mismatch fit in said portion of maximal stress.

BRIEF DESCRIPTION OF THE DRAWINGS

Reference will now be made to the accompanying drawings, showing by way of illustration a preferred embodiment of the present invention and in which.

DESCRIPTION OF THE PREFERRED EMBODIMENTS

Figure 1:
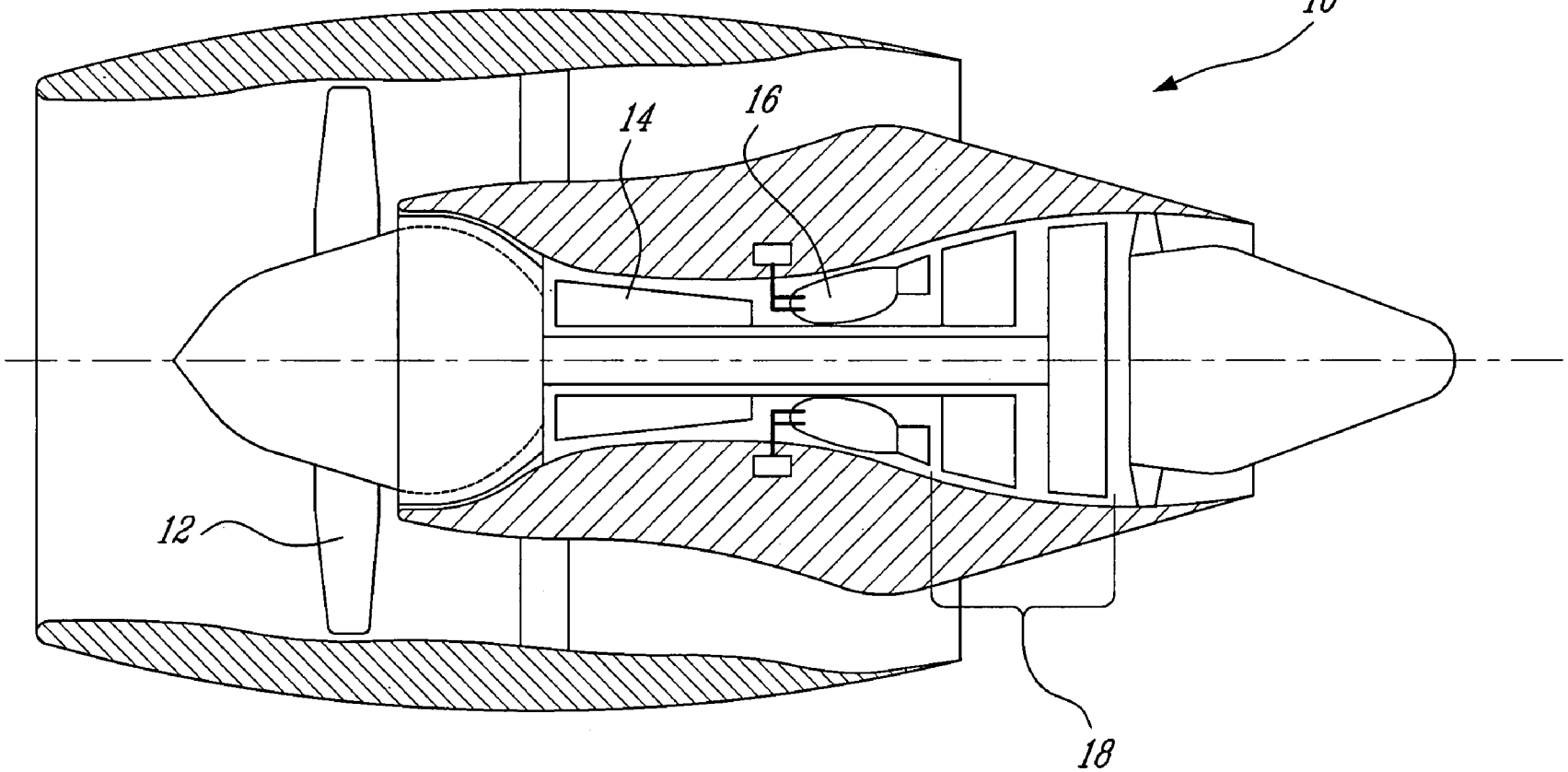
FIG. 1 is a side view of a gas turbine engine, in partial cross-section.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
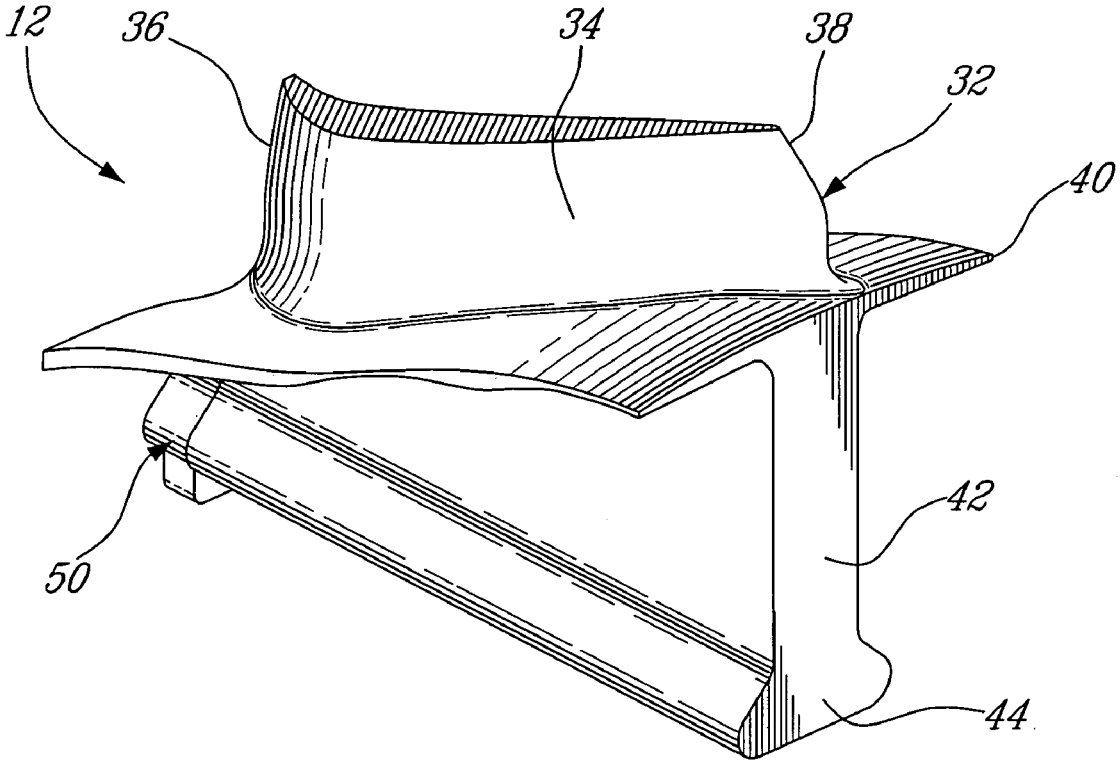
FIG. 2 is a partial perspective view of a fan blade, showing a dovetail according to a preferred embodiment of the present invention.

Referring to FIG. 2, a part of a blade 32 of the fan 12, which is a "swept" fan, is illustrated. Although the present invention applies advantageously to such fans, it is to be understood it can also be used with other types of conventional fans, as well as other types of rotating equipment requiring a smoother axial distribution of radial stress in the disk and in a disk to blade interface including, but not limited to, compressor and turbine rotors.

Figure 3:
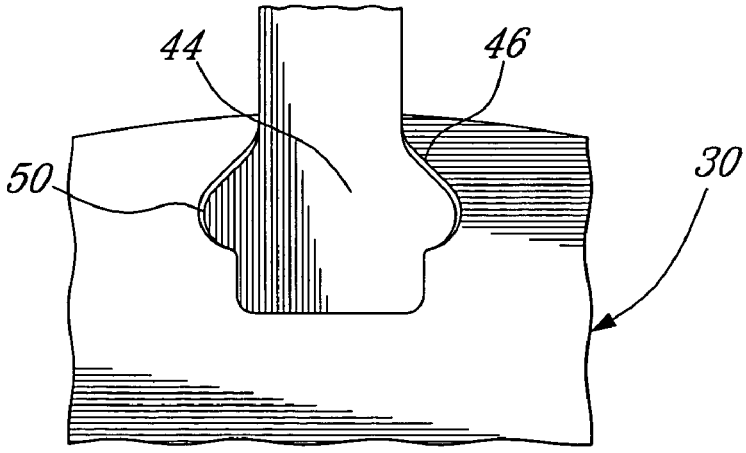
FIG. 3 is a front view of the dovetail of FIG. 2, in cross-section, when engaged in a dovetail groove of a fan disk.

Referring to FIGS. 2–3, the fan 12 includes a disk 30 supporting a plurality of the blades 32 which are asymmetric with respect to their radial axis. Each blade 32 comprises an airfoil portion 34 including a leading edge 36 in the front and a trailing edge 38 in the back. The airfoil portion 34 extends radially outwardly from a platform 40. A blade root 42 extends from the platform 40, opposite the airfoil portion 34, such as to connect the blade 32 to the disk 10. The blade root 42 includes an axially extending dovetail 44, which is designed to engage a corresponding dovetail groove 46 in the disk 10. The airfoil section 34, platform 40 and root 42 are preferably integral with one another.

As stated above, the asymmetry of the blade 32 causes a significant portion of the blade weight to be cantilevered over the front portion of the dovetail 44. This creates an uneven axial distribution of the radial load on the dovetail 44 and disk 30. Such a load distribution produces unacceptably high local radial stress in the front of the disk 30 and contact stress between the dovetail 44 and the front of the dovetail groove 46. Each airfoil portion 34 has a center of gravity which is offset axially forwardly relative to the center of the blade fixing portion 44. The blades are forward swept.

Figure 4:
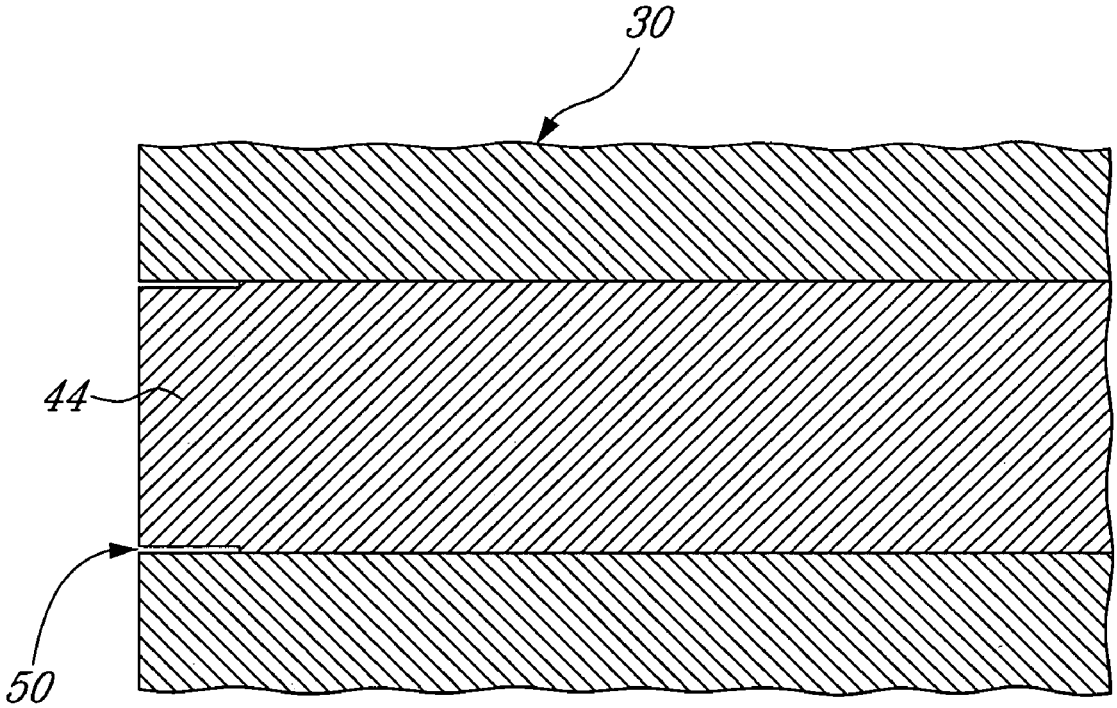
FIG. 4 is a top view of the dovetail and dovetail groove of FIG. 3, in cross-section.

Referring to FIGS. 3–4 and according to a preferred embodiment of the present invention, the high local stress in the front of the disk 30 and contact stress between the dovetail 44 and the front of the dovetail groove 46 are minimized or even cancelled by way of a relief mismatch or play 50 between the dovetail 44 and the dovetail groove 46 at the leading edge. The dovetail 44 is narrower at a front portion thereof, while the dovetail groove 46 has a constant section. This creates the mismatch 50 at the front, which minimizes or removes contact between the dovetail 44 and dovetail groove 46 at that point. As shown in FIG. 3, the mismatch 50 is preferably only present on the belly portion of the dovetail 44. The rest of the front portion of the dovetail is at the larger thickness. The minimized contact brought by the mismatch 50 reduces the local contact stress as well as the local radial stress in the disk 30 for the leading edge. The radial stress is thus redistributed along the remainder of the contact surface in the axial direction.

In a preferred embodiment, the thickness difference between the narrow front portion of the dovetail 44 and the remainder of the dovetail 44 is approximately 0.010 inches.

It understood that the localized mismatch 50 can be created in alternative ways, such as by increasing the width of the dovetail groove 46 at the front while keeping the section of the dovetail 44 constant. The mismatch 50 can also be similarly created in alternative attachments such as bottom root profiles commonly known as "fir tree" engaging a similarly shaped groove in the disk 30.

The mismatch 50 thus eliminates the unacceptably high local radial stress in the front of the disk 30 and contact forces between the dovetail 44 and the front of the dovetail groove 46 by minimizing or avoiding contact between the dovetail 44 and dovetail groove 46 in the region where the stress is maximal.

The embodiments of the invention described above are intended to be exemplary. Those skilled in the art will therefore appreciate that the foregoing description is illustrative only, and that various alternatives and modifications can be devised without departing from the spirit of the present invention. Accordingly, the present is intended to embrace all such alternatives, modifications and variances which fall within the scope of the appended claims.

The invention claimed is:

1. A gas turbine engine rotor assembly comprising a rotor disk having a plurality of blade mounting slots circumferentially distributed about a periphery of the rotor disk for receiving complementary blade fixing portions of swept blades, each of said blade mounting slots being bounded by a pair of opposed sidewalls extending longitudinally from a front side to a rear side of the rotor disk, a portion of the weight of said swept blades being cantilevered over front portions of said blade fixings, each swept blade having an airfoil portion with a center of gravity which is offset axially forwardly relative to the center of the blade fixing portion, and wherein a localized lateral play is provided between the sidewalls of each slot and the blade fixing portion of a respective one of the swept blades along a longitudinal front portion where contact stress is maximal, said longitudinal front portion being smaller than a length of the blade mounting slot and the blade fixing portion.

2. A gas turbine engine rotor assembly as defined in claim 1, wherein said localized lateral play is at least partly provided by a region of reduced width in said blade fixing portion.

3. A gas turbine engine rotor assembly as defined in claim 2, wherein said region of reduced width is provided at a front portion of the blade fixing portion.

4. A gas turbine engine rotor assembly as defined in claim 1, wherein said rotor assembly is a swept fan.

5. A gas turbine engine rotor assembly as defined in claim 1, wherein said blade fixing of each of said swept blades has a front portion which is narrower than a remaining longitudinal portion of the blade fixing.

6. A gas turbine engine rotor blade mountable in a blade retaining slot of a rotor disk, the rotor blade comprises a platform, an airfoil portion extending upwardly from said platform, a root depending downwardly from said platform and adapted for engagement in the blade retaining slot of the rotor disk, the blade having an asymmetric profile with a significant portion of the weight of the blade cantilevered over a front portion of the root, said root having a length extending from a front side to a rear side of the root, and wherein the root has a localized reduced width along a front end of the root portion where contact stress between the root and the slot is high, the front end portion having a length smaller than a full length of said root, and wherein said front end portion of reduced width is provided by cutouts defined in opposed sides of the root.

7. A gas turbine engine rotor blade, as defined in claim 6, wherein the blade is a forward swept fan blade.

* * * * *